United States Patent [19]

Itoh et al.

[11] 4,116,716

[45] Sep. 26, 1978

[54] IMMERSION COOLING APPARATUS FOR HOT METAL PIPES

[75] Inventors: Kametaro Itoh; Wataru Takahashi; Yoshun Yamamoto; Hachiro Harajiri, all of Kitakyushu, Japan

[73] Assignee: Nippon Steel Corporation, Tokyo, Japan

[21] Appl. No.: 777,547

[22] Filed: Mar. 14, 1977

[30] Foreign Application Priority Data

Dec. 29, 1976 [JP] Japan ..... 51-160719

[51] Int. Cl.[2] ..... B08B 9/02

[52] U.S. Cl. ..... 134/134; 134/152; 134/165; 134/170; 148/153

[58] Field of Search ..... 134/52–55, 134/134, 152, 165, 166 C, 167 C–169 C, 170; 266/114; 148/143, 153

[56] References Cited

U.S. PATENT DOCUMENTS 1,984,771 12/1934 Speller ..... 134/166 C 3,623,716 11/1971 Fritsch ..... 148/153 X 3,915,763 10/1975 Jennings et al. ..... 148/153 X

FOREIGN PATENT DOCUMENTS 494,206 2/1976 U.S.S.R. ..... 134/134

*Primary Examiner*—Robert L. Bleutge

[57] ABSTRACT

An immersion cooling apparatus includes a mechanism for immersing a hot metal pipe with the axis thereof directed horizontally in a cooling tank containing cooling liquid, and a mechanism for locking the immersed pipe in position in the cooling tank. While the locking mechanism is preventing the pipe from moving, a nozzle extending toward the interior of the pipe in the direction of the pipe axis injects cooling liquid into the pipe. The cooling liquid thus injected flows completely through the pipe so that the pipe being cooled is not injured or bent.

8 Claims, 11 Drawing Figures

IMMERSION COOLING APPARATUS FOR HOT METAL PIPES

BACKGROUND OF THE INVENTION

This invention relates to a hot metal pipe immersion cooling apparatus to be used in a metal pipe manufacturing process for rapid cooling of pipes heated to a high temperature.

As compared with spray cooling, immersion cooling can provide a sufficient cooling effect by the use of smaller amounts of cooling water than for spray cooling and also requires less space for cooling equipment. In spite of these advantages, immersion cooling is not popular for the reasons discussed below, while spray cooling is predominantly practiced for pipe cooling purposes. That is, in cooling an immersed pipe, uniform cooling and pipe configuration must be ensured by sufficient agitation of cooling water around the pipe in order to achieve the necessary high cooling capability and uniformity of cooling. This process can be carried out so as to nearly attain its purpose by stirring the cooling water sufficiently by means of cooling nozzles directed at the outside of the pipe and arrayed in the circumferential and longitudinal directions of the pipe in a cooling tank. Nevertheless, however forceful and uniform such outside cooling may be, the influx of cooling water into the pipe at both ends thereof will become irregular since gas enclosed in the pipe and the water pressure are in such a relationship that the escape of gas from the pipe and the entry of cooling water into the pipe are intermittent. Hence, the inside of the pipe is subjected to irregular cooling in the longitudinal and circumferential directions thereof, which may result in over-all cooling unevenness and deformation of the pipe.

In the immersion cooling method, the pipe is rolled on or dropped along guides such as skids for being fed into the cooling tank. If then the pipe is in a posture with the axis thereof inclined, one end portion of the pipe is immersed into the cooling liquid ahead of the other portion and cooled earlier, so that the pipe undergoes uneven cooling along the length thereof. In addition, since the pipe to be cooled is at a high temperature, such rolling or dropping may easily cause abrasions or bruises on the pipe. Such uneven cooling of the pipe or flaws produced therein markedly impair the quality of the pipe. No conventional immersion cooling apparatus has been devised which is effective to prevent uneven cooling and flaws.

SUMMARY OF THE INVENTION

This invention solves the above described problems in immersion cooling of hot metal pipes, and an object of the invention is to provide an immersion cooling apparatus for hot metal pipes which ensures uniform cooling and configuration of the pipes.

Another object of this invention is to provide an immersion cooling apparatus which prevents creation of abrasions and bruises on a hot metal pipe when feeding the pipe into a cooling tank and which makes possible adjustment of the cooling speed.

Still another object of the invention is to provide an immersion cooling apparatus capable of exceedingly rapid cooling of hot metal pipes.

The present invention has the following characteristic aspects:

In one aspect, the invention provides an immersion cooling apparatus wherein a hot metal pipe is fed into a cooling tank in such a manner as to drop with its axis directed substantially horizontally. The pipe thus immersed horizontally in the cooling tank is placed on pipe supporting means, and a nozzle extending toward the interior of the pipe substantially in axial alignment therewith is used to inject cooling liquid such as cooling water in a stable jet effective for cooling the inside of the pipe. The jet tends to force the pipe downstream. The pipe is therefore locked to keep a proper distance between the end of the pipe and the injecting tip of the nozzle and also to keep the pipe free from uneven cooling, flawing and bending which might otherwise occur during the cooling operation.

In another aspect, the invention provide an immersion cooling apparatus which includes a speed control system having a moving mechanism. This speed control system permits a hot metal pipe to be fed in a level position down into a cooling tank at a constant or variable speed. This pipe feeding is carried out in such a way that the pipe is supported by the speed control system while the pipe is rolled along inclined skids or vertically dropped without rolling.

In still another aspect, a shock absorbing system is provided at the pipe locking location in the cooling tank of an immersion cooling apparatus in order to absorb the shock produced when the hot metal pipe fed into the cooling tank collides with the pipe supporting means, thereby gently stopping the pipe at the locking position in the tank. The maximum impact load is held below a fixed value irrespective of the size of the hot metal pipe so that flawing or injury to the pipe is prevented.

In still another aspect, the nozzle extending in axial alignment with the pipe immersed and locked in the cooling tank is so disposed that the distance between the injection port of the nozzle and the corresponding end of the pipe is not larger than four times the inside diameter of the pipe.

In still another aspect, in addition to the inside pipe cooling nozzle adapted to inject cooling liquid into the pipe immersed and clamped in the cooling tank so that almost all the jet entering the pipe is forced to pass therethrough an out of the opposite end of the pipe, a plurality of outside pipe cooling nozzles are spaced in the longitudinal direction of the pipe clamped in the tank.

In still another aspect, there are provided clamping or pressing devices for locking the pipe to pipe supporting means which constitute components of a pipe system. Such locking system prevents the pipe from being moved by the jet from the inside pipe cooling nozzle, thus maintaining the distance between the inside cooling nozzle and the pipe end at a value within a fixed range and preventing pipe bending.

DESCRIPTION OF THE PREFERRED EMBODIMENTS

This invention will now be described in more detail by reference to the accompanying drawings illustrating preferred embodiments thereof.

Figure 1:
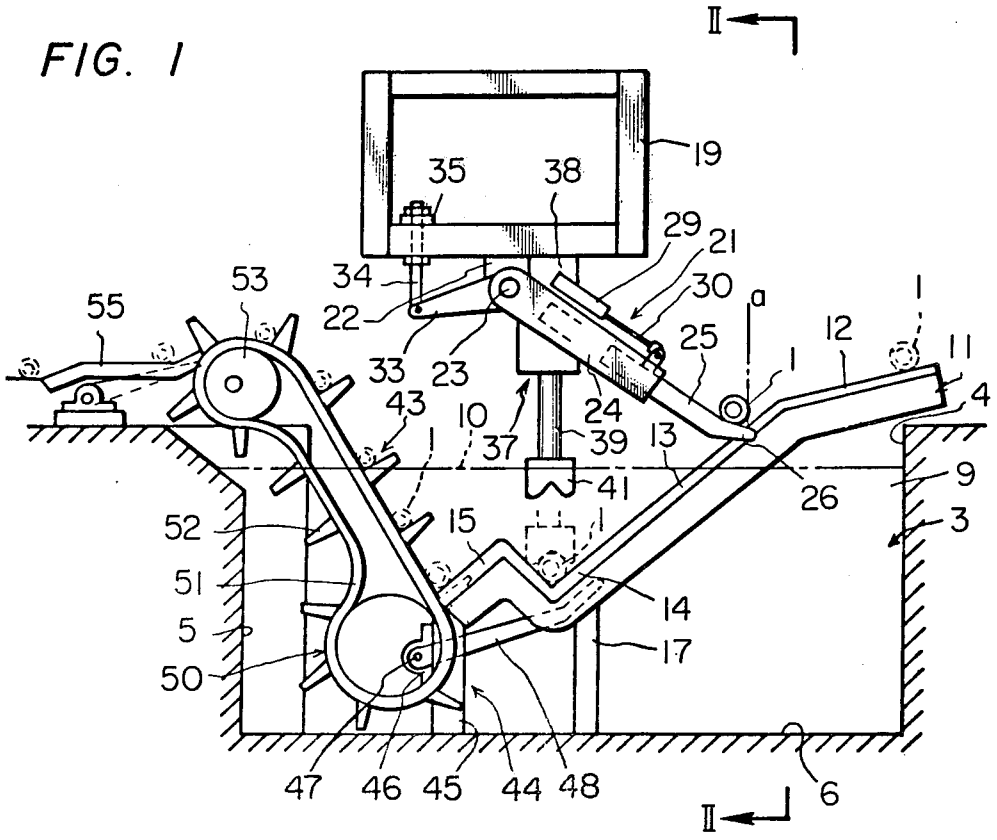
FIG. 1 is a transverse sectional view of an immersion cooling apparatus embodying the prevent invention.
Figure 2:
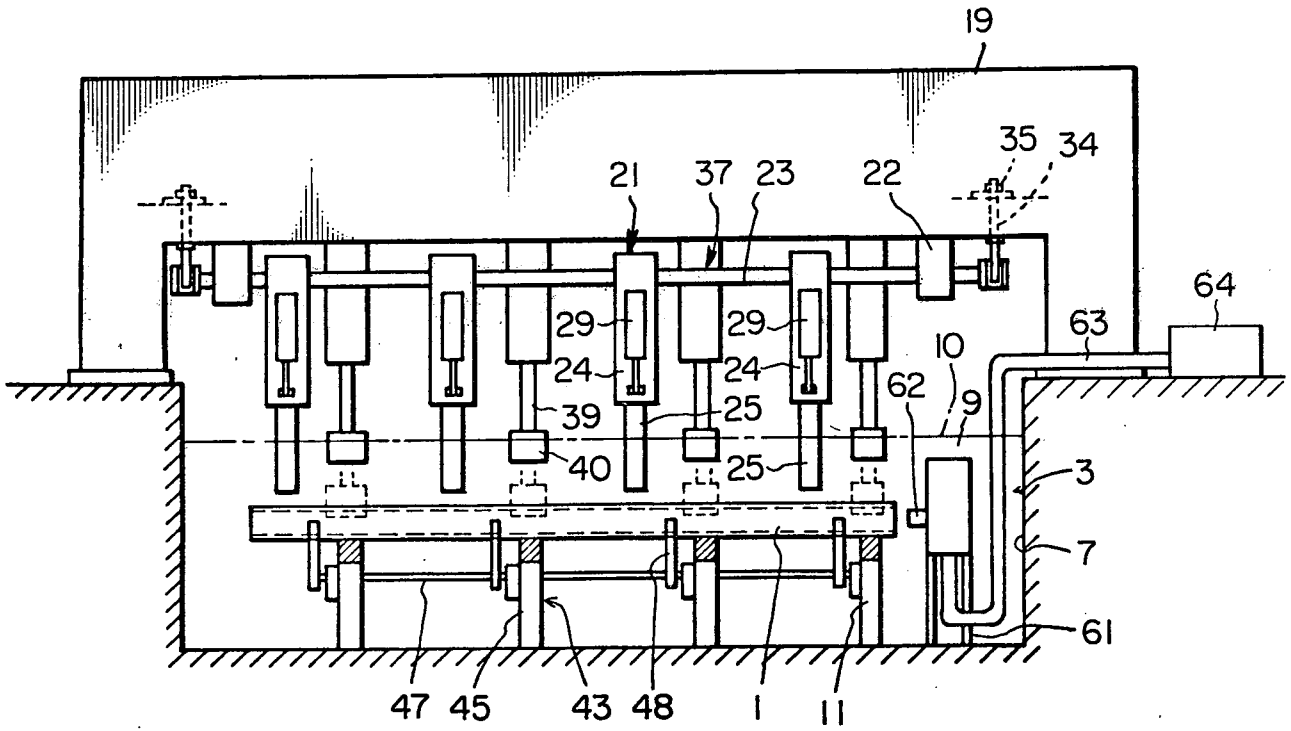
FIG. 2 is a longitudinal sectional view taken along line II—II of FIG. 1.

Referring to FIG. 1, which shows an apparatus embodying the invention, and to FIG. 2, which is a sectional view taken along line II—II of FIG. 1, a cooling tank 3 is filled with cooling liquid 9 (water in this embodiment) up to a level 10, and a pipe 1 to be cooled by immersion in the cooling tank 3 is placed therein so as to extend horizontally in the longitudinal direction of the tank.

Skids 11 slope downwardly from a position near the top of a longitudinal wall 4 of the cooling tank 3 and extend into the vicinity of the center of the cooling tank 3. Each skid 11 comprises a gently sloping receiving portion 12, a steep sloping portion 13, a V-shaped supporting portion 14 and a downwardly inclined sweeping portion 15. The plurality (four in this embodiment) of skids 11 are arrayed in the longitudinal direction of the cooling tank 3 and each is supported by a strut 17.

A framework 19 spans the cooling tank 3 longitudinally thereof, and a pipe leveling system 21 is attached to the framework 19 to position the pipe 1 with its axis directed horizontally. More particularly, the framework 19 has a bearing 22 secured thereto near each of the opposite ends thereof to support a rotating shaft 23. A plurality of hollow actuating levers 24 are firmly attached to the rotating shaft 23 and are directed toward the steep sloping portions 13 of the skids 11. Each actuating lever 24 has an elongated holding member 25 slidably inserted therein for temporarily supporting the pipe 1 on the skids 11 so as to level the pipe. A fluid pressure cylinder (air cylinder or hydraulic cylinder) 29 is secured to each actuating lever 24 and has a rod 30 connected to the holding member 25 near the rear end thereof. The holding members 25 are moved back and forth by the rods 30 of the fluid pressure cylinders 29. The holding members 25 are thus extended until respective tip portions 26 thereof move past the upper surface of the skids 11. When the holders 25 are retracted, the tip portions 26 move away from the skids 11 so that the pipe 1 rolls downward on the skids. Secured to each of the opposite ends of the rotating shaft 23 is one end of an arm 33, the other end of which is connected to an adjusting threaded rod 34 vertically movably attached to the framework 19. When both adjusting threaded rods 34 are lowered by loosening nuts 35 fitted thereto, the actuating levers 24 will rotate counterclockwise as viewed in FIG. 1, so that the pipe leveling position will shift upwardly. Raising the adjusting threaded rods 34 will cause the pipe leveling position to shift in the opposite direction.

The framework 19 is provided with pressing device 37 adapted to press the pipe 1 onto the supporting portions 14 of the skids 11 to clamp the pipe. More particularly, the framework 19 is furnished with a plurality of fluid pressure cylinders 38 located immediately above the supporting portions 14 and spaced longitudinally along the framework. Each fluid pressure cylinder 38 has a rod 39 terminating in a clamp 40 having an inverted V-shaped recess therein which faces the supporting portion 14 of the corresponding skid 11. The pipe 1 is to be pressed by the clamp 40 onto the supporting portion 14 and thus locked therebetween.

At the outlet end of the skids 11 there are provided a plurality of conveying devices 43 each comprising, as main components, a sweeping device 44 and a conveyer 50. A plurality of struts 45 for the sweeping devices 44 are erected along the longitudinal direction of the cooling tank 3 and are provided with respective bearings 46 for supporting a rotating shaft 47. Securely mounted on the rotating shaft 47 are a plurality of sweeping arms 48 with respective tip portions extending side by side with the supporting portions 14 of the skids 11. The rotating shaft 47 is rotated by driving means (not shown). Each conveyer 50 comprises an endless chain 51 extending from outlet end of the skid 11 to the upper end of the other longitudinal wall 5 of the cooling tank 3 and is provided with a multiplicity of adequately spaced apart claws 52. The endless chain 51 is driven by driving means (not shown) through a chain wheel 53. On the outlet side of the conveyer 50 there is provided a sweeping platform 55. Such conveying devices 43 are spaced in the longitudinal direction of the cooling tank 3.

A cooling nozzle 62 is mounted on a mount 61 adjacent a side end 7 of the cooling tank 3. The cooling nozzle 62 is adequately spaced from an end of the pipe 1 locked on the skids 11 and is directed toward the pipe interior. Cooling liquid will be supplied to the inside pipe cooling nozzle 62 from a liquid source 64 through a supply pipe line 63 under sufficient pressure for flowing through the pipe 1.

Operation of the immersion cooling apparatus thus constructed will now be described.

First, the adjusting threaded rods 34 of the pipe leveling system 21 are moved up or down to turn the actuating levers 24 so as to adjust the position where the holding members 25 intersect the steep sloping portions 13 of the skids 11, that is, the pipe leveling position "a". This position "a" will be set properly for the pipe 1 to be positioned horizontally above the liquid level 10 and to mimimize the shock exerted when the pipe 1 collides with the supporting portions 14 of the skids 11. After the pipe leveling position "a" has thus been adjusted, the holding members 25 are caused to protrude and remain across the portions 13 of the skids 11.

Hot pipes 1 to be cooled are carried one after another to the inlet side of the receiving portions 12 of the skids 11 by a conveying device (not shown) such as a roller table. A pipe 1 placed on the inlet ends of the inclined receiving portions 12 starts rolling down along the receiving portions and is stopped by the holding members 25, which temporarily hold the pipe 1 in a horizontal position. Subsequently, the fluid pressure cylinders 29 are operated to retract the holding members 25 with the result that the pipe 1, while maintained in its level position, rolls down the portions 13 of the skids 11 until it strikes against the upwardly sloping surfaces of the supporting portions 14. When the pipe 1 is thus stopped, the fluid pressure cylinders 38 of the pressing devices 37 are operated to lower the clamps 40 to hold the pipe between the clamps 40 and the supporting portions 14.

Immediately after the pipe 1 has thus been clamped, cooling liquid is injected into that end of the pipe 1 adjacent the pipe cooling nozzle 62 from the pipe cooling nozzle 62 and flows through the pipe 1 while inducing thereinto cooling liquid present in the vicinity of that end of the pipe. The flow of cooling liquid through the pipe 1 cools it rapidly and uniformly along the length thereof. The pipe being cooled is locked as described hereinbefore so that it is impossible for the cooling liquid flow to force the pipe 1 to move in the longitudinal direction thereof.

After completion of cooling the pipe 1, the clamps 40 of the pressing devices 37 are elevated, and subsequently the sweeping arms 48 of the conveying devices 43 are rotated counterclockwise as viewed in FIG. 1. As a result, the pipe 1 on the supporting portions 14 is carried over the sweeping portions 15 onto the conveyers 50, which convey the pipe 1 up to the sweeping platforms 55. The pipe 1 placed on the sweeping platforms 55 is delivered to the succeeding operation stage by a conveying device (not shown) such as a roller table. Control of the speed of the conveyers 50 also allows adjustment of the cooling time period so that satisfactory cooling can be effected.

In the foregoing embodiment, fluid pressure cylinders are employed as the driving means for the pipe leveling system 21 and the pressing devices 37. However, such cylinders could be replaced by electric means. The above described driving means are preadjusted so that the pipe 1 supported on the supporting portions 14 will not be crushed when the pipe is clamped under pressure by the pressing devices 37. Furthermore, the aforesaid steps of the cooling operation can be carried out either manually or fully automatically.

The pipe 1 is first set in a horizontal position and then immersed in the cooling liquid 9 so that there is no possibility that one end of the pipe 1 will be dipped in the cooling liquid prior to the other end thereof and thus cooled earlier. This also allows uniform cooling of the pipe.

As described hereinabove, this invention contemplates temporary leveling of the pipe 1 on the skids and dropping the pipe along the skids down to the supporting portions thereof. In this regard, it is desired to control the dropping speed for controlling the pipe cooling speed or alleviation of the shock to the pipe due to its collision with the supporting portions. If the dropping speed can be controlled, it is also possible to drop the pipe without rotation along nearly vertical skids. Such steep skid inclination allows decreased skid length and, hence, decreased width of the cooling tank.

Figure 3:
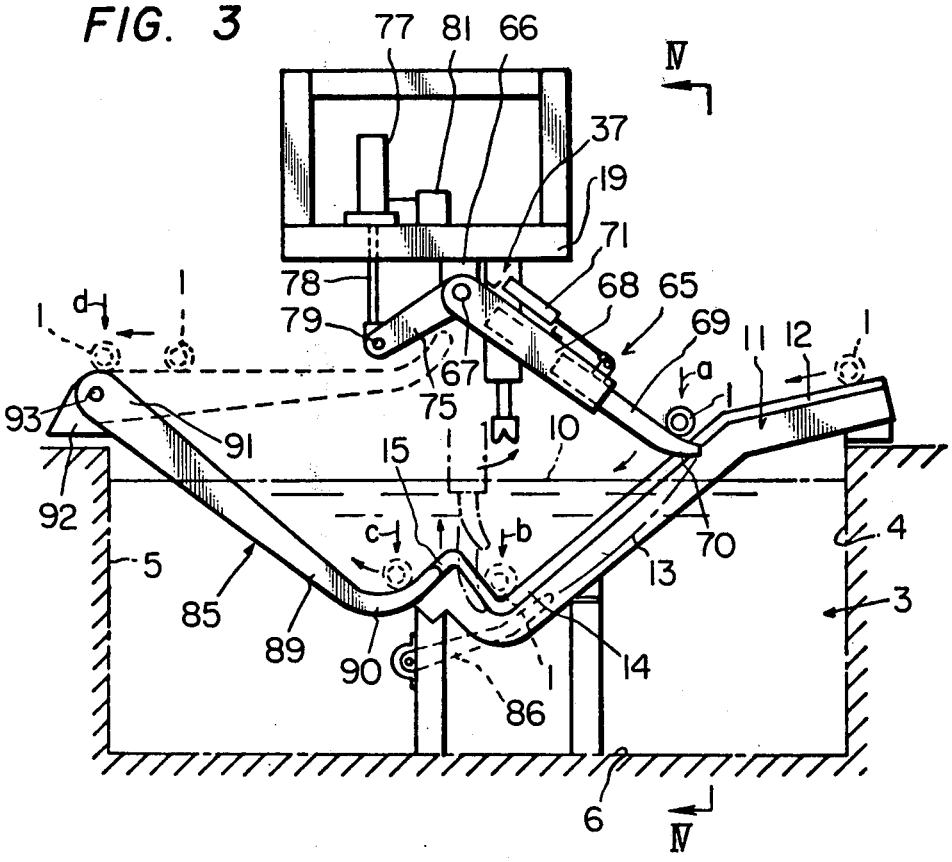
FIG. 3 is a transverse sectional view of another embodiment of the invention.
Figure 4:
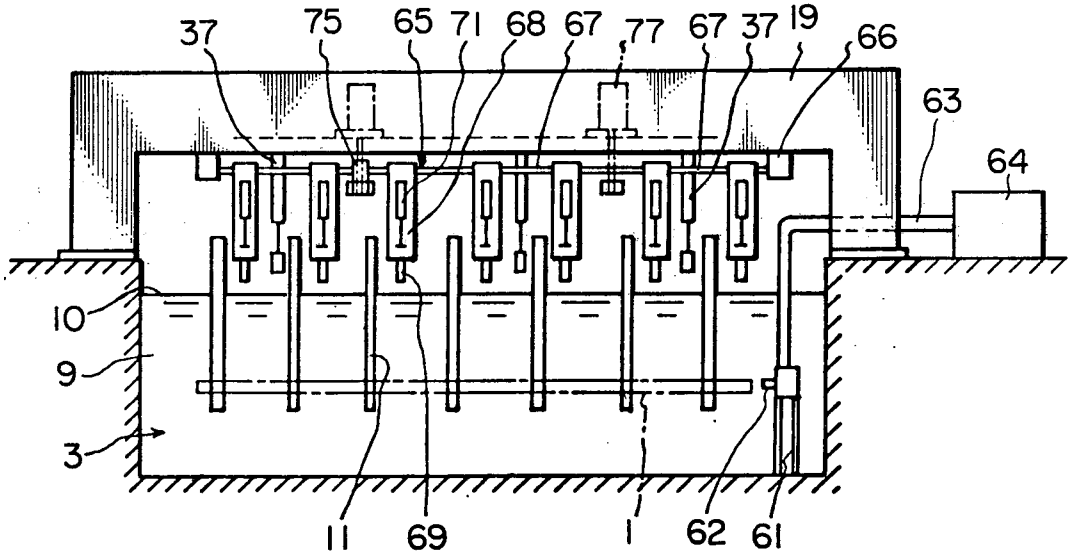
FIG. 4 is a longitudinal sectional view taken along line IV—IV of FIG. 3.

Referring to FIGS. 3 and 4, there is shown an embodiment of an immersion cooling apparatus having the above described capability of controlling the pipe dropping speed.

This embodiment includes the same cooling tank 3, skids 11, framework 19 and pressing devices 37 attached thereto, inside pipe cooling nozzle 62, and other components as those in the foregoing or first embodiment.

The framework 19 is provided with a speed control system 65 for leveling the pipe 1 and dropping it at required speeds along the sloping portions 13 of the skids 11 down to the supporting portions 14. More particularly, the framework 19 is equipped with bearings 66, rotating shaft 67, actuating levers 68, holding members 69, fluid pressure cylinders 71 and arms 75 similar to those in the foregoing embodiment in the same manner as therein. The framework 19 is also provided with fluid pressure cylinders 77 having rods 78 connected at the tips thereof to the ends of the arms 75 by pins 79. The operation of the fluid pressure cylinders 77 is controlled by a control system 81 including a pump, metering and transfer valves, and the like.

Conveying devices 85 comprise the same sweeping arms 86 as in the preceding embodiment and conveying kickers 89 replacing the aforesaid conveyers. The conveying kickers 89 are supported at respective base ends 91 thereof by bearings 92 and a rotating shaft 93 near the top of the longitudinal wall 5 of the cooling tank 3, and have respective curved tip portions 90 extending to the sweeping portions 15 of the skids 11. The conveying kickers 89 are rotated together with the rotating shaft 93 by driving means (not shown).

The immersion cooling apparatus thus constructed is operated as follows. First, the fluid pressure cylinders 77 are operated to rotate the actuating levers 68. Then, the fluid pressure cylinders 71 are operated to advance the holding members 69 until the top portions 70 thereof cross the sloping portions 13 of the skids 11 at the position "a". With the holding members 69 thus positioned, the hot metal pipe 1 is advanced thereto from the receiving portions 12 of the skids 11 and horizontally held by the holding members 69. Next, the fluid pressure cylinders 77 are again operated to rotate the actuating levers 68 clockwise as viewed in FIG. 3, thereby lowering the tip portions 70 of the holding members 69 along the sloping portions 13 of the skids 11. The pipe 1 is thus lowered from the position "a" to the supporting portions 14 while being held by the holding members 69. The actuating levers 68 stop after the holding members 69 reach a position slightly ahead of the pipe locking position "b". When actuating levers 68 have stopped, the fluid pressure cylinders 71 are operated to retract the holding members 69, and the fluid pressure cylinders 77 are operated to return the actuating levers 68 to the original position thereof. After completion of this returning operation, the holding members 69 are extended as described hereinbefore and wait for the next pipe. The cooled pipe 1 is swept off by the sweeping arms 86 onto the tip portions 90 of the conveying kickers 89, which are then swung up so that the pipe 1 rolls from the tip portions 90 to the base ends 91 and is turned out.

In the aforesaid operation, the rotating speed of the actuating levers 68, that is, the dropping speed of the pipe 1 is controlled in accordance with the size and material of the pipe, for example. Hence, the pipe cooling characteristics can be varied to provide improved pipe quality. It is also possible to restrain the pipe 1 from moving apart from the upper surfaces of the skids due to its buoyancy when the pipe is submerged between the points "a" and "b" on the skids 11, or to cause the inertia of the pipe 1 when it gets to the point "b" to be held to a relatively small value by speed control, thereby protecting the pipe from deformation or flawing.

In the conveying system 85, the conveying kickers 89 may be replaced by the conveyers 50 used in the preceding embodiment.

In the above described second embodiment, when the pipe falls along the skids, the rotating speed of the actuating levers is controlled to lessen the collision shock on the pipe, whereas in a further embodiment the immersion cooling apparatus can be provided with a shock absorbing system. This embodiment includes the same framework, pipe leveling system, pressing devices, cooling nozzle, and other components as employed in the aforesaid components will not be repeated.

Figure 6:
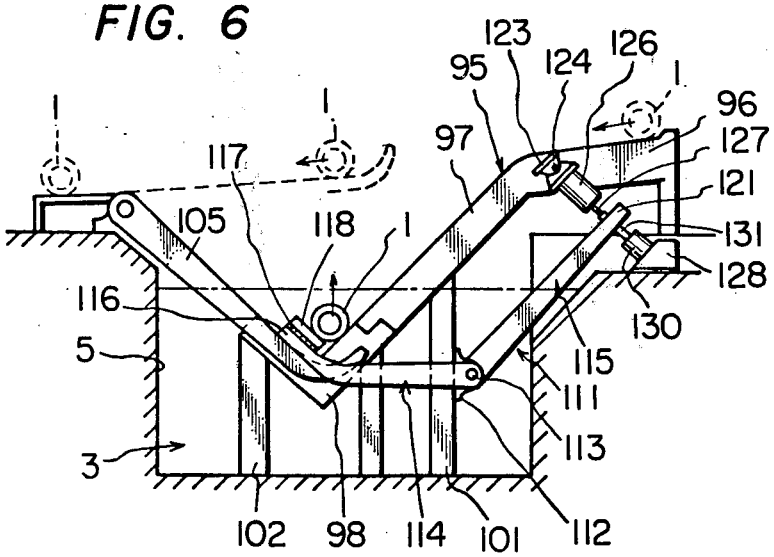
FIG. 6 is a transverse sectional view taken along line VI—VI of FIG. 5.
Figure 5:
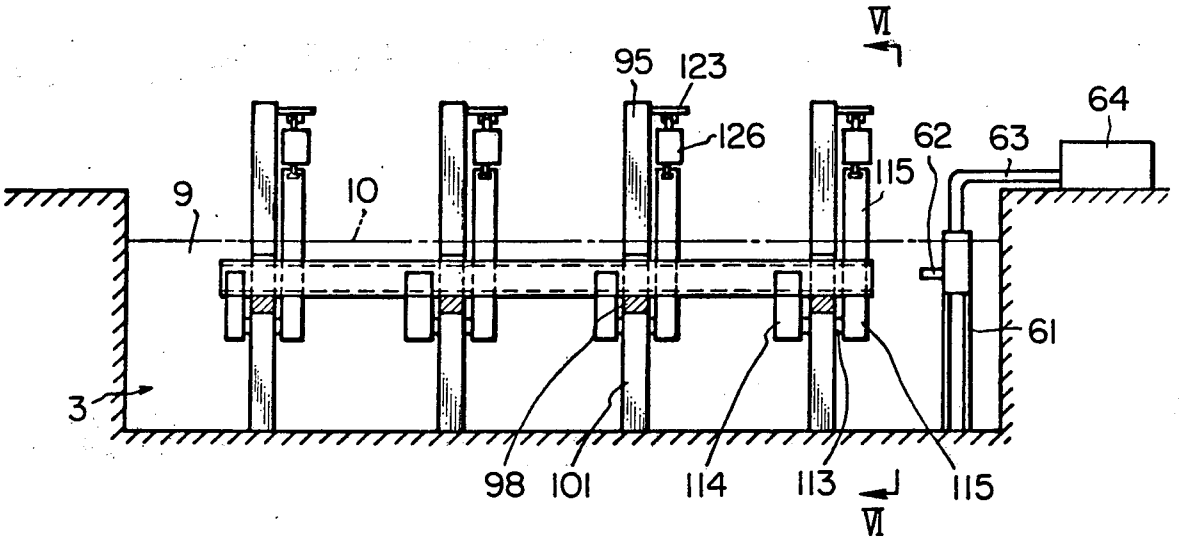
FIG. 5 is a longitudinal sectional view, with some parts omitted, of an immersion cooling apparatus according to the invention including a shock absorbing system.

In this further embodiment, which is illustrated in FIGS. 5 and 6, skids 95 have nearly the same construction as in the preceding embodiments, each skid having a sloping portion 97 and a supporting portion 98 which are supported on supports 101 and 102 respectively. The skids 95 are arranged at adequate intervals in the longitudinal direction of the cooling tank 3. The sloping portion 97 may be provided separately from the supporting portion 98 out of the tank. Means for conveying the pipe 1 from the supporting portion 98 comprise the same conveying kickers 105 as in the second embodiment.

A shock absorbing system 111 is provided adjacent the skids 95. More particularly, bearings 112 are secured to the respective supports 101 and support a rotating shaft 113. Shock receiving levers 114 having respective tip portions 116 extending to the supporting portions 98 of the skids 95 and shock receiving levers 115 having respective rear end portions 121 extending into the vicinity of the receiving portions 96 of the skids 95 are securely mounted on the rotating shaft 113. The tip portion 116 of each shock receiving lever 114 has a receiving plate 118 attached thereto through an elastic member 117 (such as rubber). The receiving plate 118 serves to protect the elastic member 117 when the pipe 1 is very hot. The initial impact or collision force of the pipe 1 will be received by the elastic member 117. A bracket 123 is fastened to a side of the receiving portion 96 of each skid 95, and a damper 126 is rotatably mounted on the bracket 123 by a pin 124. The damper 126 may be of any known type, such as the dash pot or constant load device. A base 128 is secured onto a floor at a position opposed to each damper 126, and a shock receiving lever position adjustor 130 is attached to the base 128. The damper 126 has a movable rod 127 while the shock receiving lever position adjustor 130 has an adjusting rod 131. The two rods 127 and 131 hold therebetween the rear end portion 121 of the shock receiving lever 115, extending perpendicularly to the lever. The shock receiving lever position adjustor 130 needs to be adjusted for adjustment of the deflection or damping force of the damper 126 or according to changes in pipe specifications such as size and weight. When it is desired to allow the tip portion 116 of the shock receiving lever 114 to move further downward or in order to adjust the position of the pipe 1 properly with respect to the supporting portion 98, the shock receiving lever position adjustor 130 is used with the extent of projection of the adjusting rod 131 being adjusted. As the lever position adjustor 130, hydraulic, pneumatic, electric screw and other means can be utilized.

In this embodiment, the elastic material 117 is preferably rubber and is illustrated as being attached to the tip portion 116 of the shock receiving lever 114. However, the shock receiving lever 114 may be provided with an elastic member at any appropriate position. For example, the shock receiving lever 114 may be connected by a spring to the longitudinal wall 5 of the cooling tank 3, the support 101, or the like. It is alternatively possible to attach a spring to the tip of the rod 127 of the damper 126. In short, what is required is an arrangement in which an elastic member receives the initial impact of the pipe 1 while the damper 126 receives the impact force through the elastic shock absorber.

The shock absorbing system 111 having such a construction operates as described hereinafter. The pipe 1 having moved over the receiving portions 96 of the skids 95 and rolled down over the sloping portions 97 collides with the receiving plates 118 of the shock receiving levers 114 in front of the supporting portions 98, and the initial impact force is absorbed by the elastic members 117 through elastic deformation thereof. The remaining impact force acts on the shock receiving levers 114 to rotate the levers 114 about the axis of the shaft 113 so that the impact force further acts, through the shock receiving levers 115, on the dampers 126 and is absorbed thereby through spring deflection or the like. Thus, the impact load is held below a predetermined value.

Figure 7:
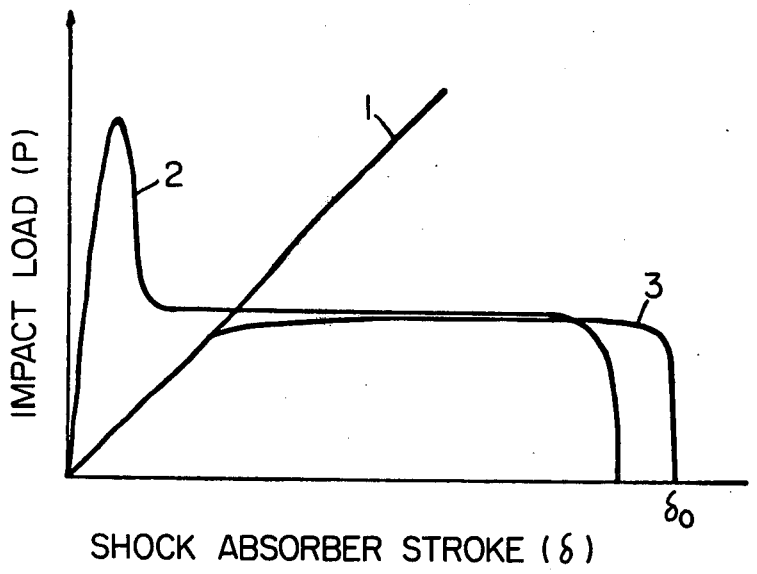
FIG. 7 is a graphic representation of the relation between the shock absorber stroke and impact load.

FIG. 7 shows, for different types of shock absorbers, the relation between shock absorbing displacement and impact load exerted thereon. The numeral 1 designates the curve for a spring type shock absorber. The shock absorbing displacement of the spring type device is proportional to the maximum impact load. A high collision speed or a heavy pipe material produces a great amount of collision energy so that the maximum impact load is increased and may cause injuries to the pipe. In addition to this disadvantage, as due to a phenomenon characteristic of a spring, there occurs springing-back after absorption of the collision shock. As a result, the pipe vibrates and substantial time passes before such vibration stops. The numeral 2 designates the curve for a dash pot type or constant load type shock absorber. With such an absorber there occurs a peak load at the initial stage of the collision of the pipe with the shock absorber. The higher the collision speed, the greater the peak load. The pipe is therefore liable to suffer injuries or flaws.

The shock absorbing system illustrated in the embodiments of this invention overcomes the above described disadvantages, and the impact or impulsive force applied to the pipe is reduced sufficiently so that no flaws are produced. That is, the initial impact of the dropped pipe is alleviated by the elastic members 117, and the impact force received by the elastic members 117 is reduced by the dampers 126. As shown by curve 3 in FIG. 7, the elastic characteristics of rubber, springs or the like can be effectively combined with the characteristics of the dampers 126 to hold the impact load below a predetermined load.

Here follows a description of the cooling nozzle used in the immersion cooling apparatus of the present invention.

The ratio of the inside diameter of the cooling nozzle (designated 62 in the foregoing embodiments) for cooling the inside of the pipe to the inside diameter of the pipe to be cooled is normally below one. The jet from the cooling nozzle induces surrounding stationary cooling liquid into the pipe by an induction effect. The cooling liquid thus induced flows into the pipe at the end thereof adjacent the nozzle and is discharged out of the other end of the pipe, thereby promoting the cooling of the pipe from inside.

Axial alignment of the cooling nozzle and the pipe in accordance with changes in pipe size is carried out by causing vertical movement of the cooling nozzle or pipe locking means. Also, adjustment of the distance between the tip of the cooling nozzle and the adjacent end of the pipe is normally performed in the following manner. First, the cooling nozzle is fixed. Then, at the time when the pipe is carried to the front of the skids by a roller table or the like, the pipe is stopped at a position preset by a stop on the table line. Then, after adjusting the pipe position in the longitudinal direction, the pipe is fed into the cooling tank, wherein the pipe is supported and locked at a fixed position.

In the prior art, after the pipe is firmly supported in the cooling tank, a clamping device fitted on the cooling nozzle is fastened to the tip of the pipe. Then, the cooling nozzle is advanced until the nozzle tip is inserted into the pipe to inject cooling liquid thereinto. Thus, cooling is effected with a negative distance between the tip of the cooling nozzle and the adjacent end of the pipe.

Figure 8:
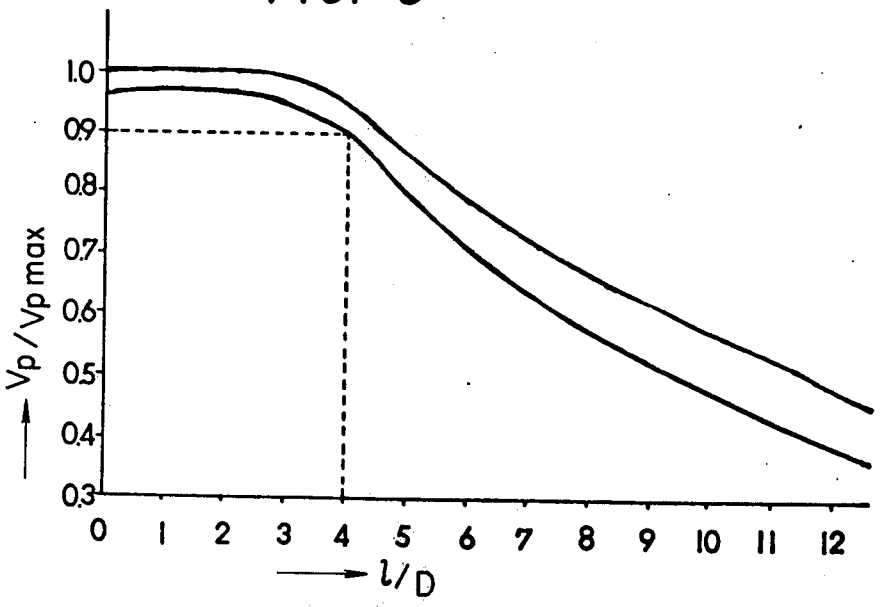
FIG. 8 is a graphic representation of the relation between the distance from the tip of a nozzle to the end of a pipe and the flow velocity of cooling liquid within the pipe.

In contrast to such prior art arrangement, the present invention provides a clearance between the tip of the cooling nozzle and the adjacent end of the, so that the construction is very simple, allowing pipe cooling of the inside of the pipe to be quickly started. In FIG. 8, the abscissa has the values for the ratio l/D, wherein "l" represents the distance between the tip of the cooling nozzle and the adjacent end of the pipe while "D" denotes the inside diameter of the pipe. The ordinate has the values for the ratio Vp/Vpmax, that is, the flow velocity Vp within the pipe positioned at any distance l, divided by the maximum flow velocity Vpmax. The zone between the curves seen in FIG. 8 shows an empirically ascertained relationship between l/D and Vp/Vpmax. The width of the zone shows the dispersion of experimental values obtained with cooling nozzle diameter, inside pipe diameter and injection pressure used as parameters. According to this experimental result, an excessive increase in the ratio l/D, or the distance l, brings about insufficient influx of cooling liquid into the pipe owing to the divergence of the jet from the cooling nozzle. Consequently, the flow velocity inside the pipe becomes so low that the effect of cooling the pipe from inside is markedly lowered. It has been found as an experimental result that effective cooling is practicable by maintaining the condition $Vp/Vpmax > 0.9$, that is, $l/D < 4$. It is clear of course that the condition $l/D > 0$ must hold in order to keep the tip of the cooling nozzle out of contact with the adjacent end of the pipe.

In the foregoing embodiments, the cooling nozzle is only for jetting cooling liquid into the pipe. However, if there are also provided a plurality of cooling nozzles directed toward the outside of the pipe in order to jet cooling liquid toward the pipe, the pipe can be cooled in accordance with the cooling conditions inside the pipe and the size thereof. Thus, cooling liquid is agitated adequately for the size of each pipe by changing the jetting directions and positions of the cooling nozzles directed toward the outside of the pipe (such nozzles being hereinafter referred to as "outside pipe cooling nozzles") and by adjusting the flow rate and the jet pressure. This allows a relatively small number of nozzles to provide optimum cooling conditions for various pipe sizes. Because of the small number of outside pipe cooling nozzles, there may occur fewer troubles due to nozzle clogging and the like, and it is also possible to replace the tips of the outside pipe cooling nozzles at the time of roll replacement in the pipe rolling mill in accordance with pipe size change. It is of course possible to reduce the jetting position changing range by replacing the tips of the outside pipe cooling nozzles.

Figure 9:
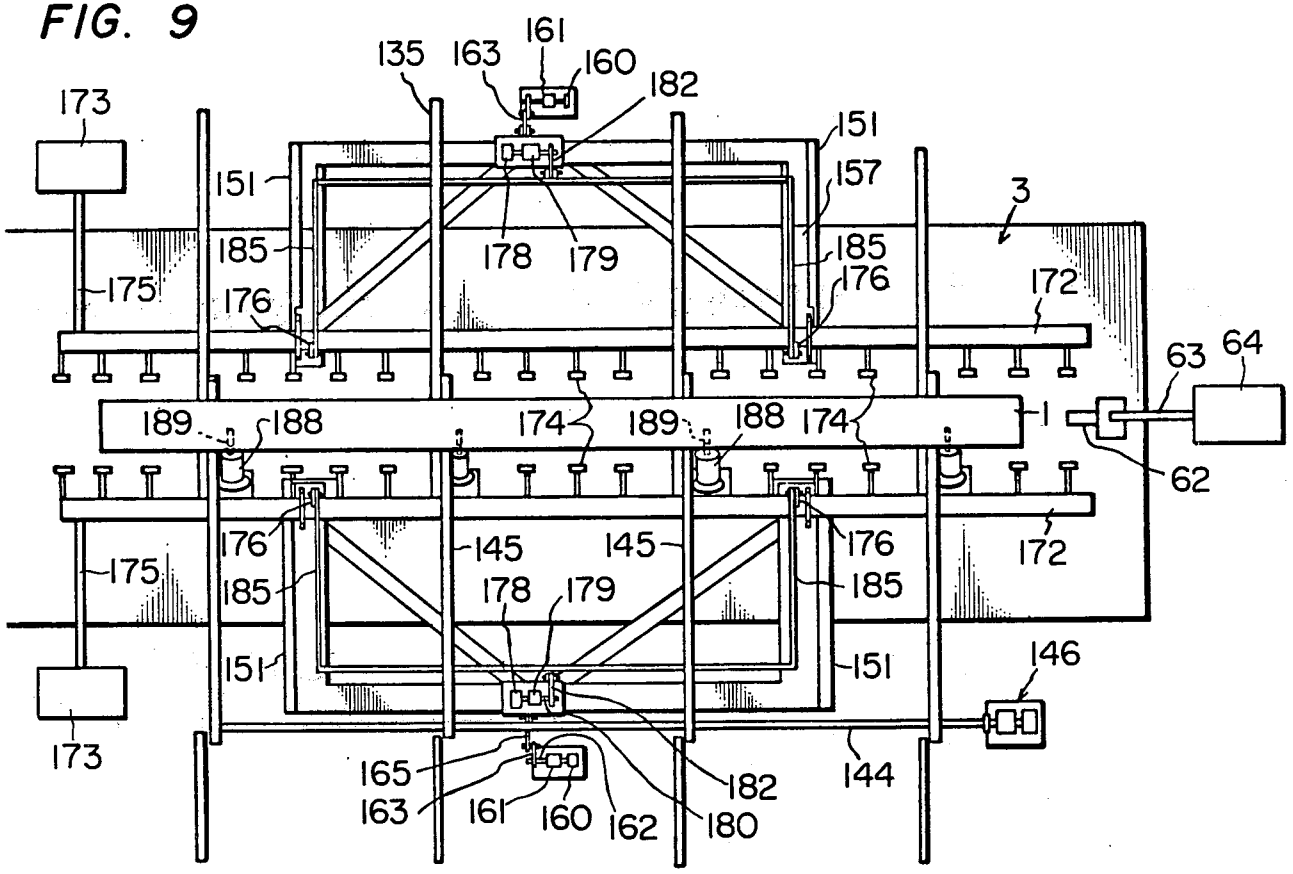
FIGS. 9 and 10 are respectively plan and transverse end views, with parts omitted, of an immersion cooling apparatus according to the invention having outside pipe cooling nozzles.
Figure 10:
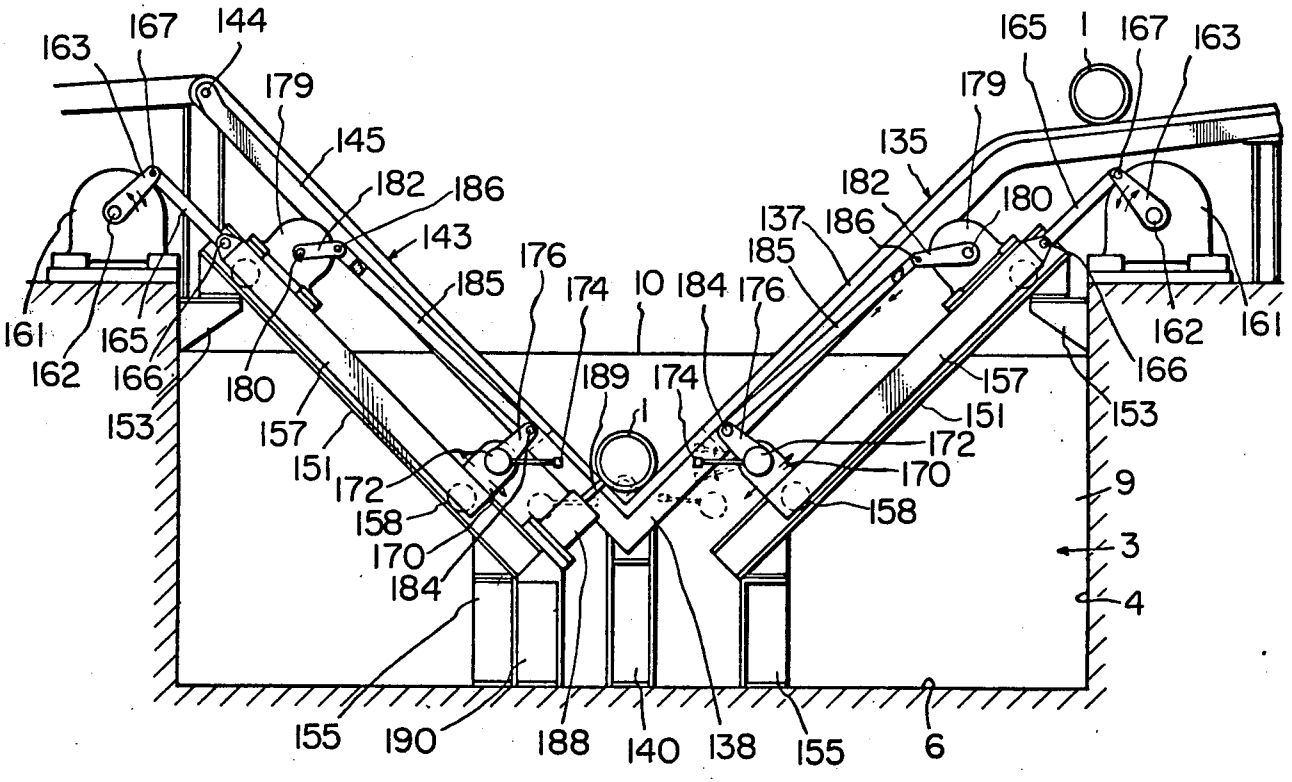

FIGS. 9 and 10 show an embodiment of an immersion cooling apparatus having an inside pipe cooling nozzle and outside pipe cooling nozzles. In this embodiment, the same framework, pipe leveling system, pressing devices, inside pipe cooling nozzle and other components as in the first embodiment are employed; therefore, the description thereof will not be repeated.

Skids 135 are adequately spaced apart in the longitudinal direction of the cooling tank 3. Each skid 135 includes a V-shaped supporting portion 138 supported on a support 140. A conveying device 143 is opposed to each skid 135 and comprises a conveying kicker 145 rotatable by a shaft 144, which kicker is similar to that in the preceding embodiment, and driving means 146 for rotating the conveying kicker 145.

In the cooling tank 3, a pair of guide rails 151 which are adequately spaced in the longitudinal direction of the tank and extend in parallel with the skids are supported by brackets 153 affixed to the wall 4 of the tank and on supports 155 erected on the bottom 6 of the tank. Another pair of guide rails 151 similar to the above described pair are opposed thereto and are parallel with the conveying devices 143 with the supporting portions 138 of the skids 135 being between the pairs of guide rails. On each pair of guide rails 151 there is mounted a U-shaped truck 157 provided with wheels 158. A motor 160 and a speed reduction gear 161 are provided adjacent the cooling tank 3, and the reduction gear 161 has an output shaft 162 to which a driving arm 163 is secured. A connecting rod 165 is rotatably connected by a pin 166 to the truck 157 at the center of the upper end thereof. The connecting rod 165 is also rotatably connected at the tip thereof to the tip of the driving arm 163 by a pin 167.

The truck 157 has a base 170 secured thereto near each of the two lower ends thereof, and a header 172 extending in the longitudinal direction of the cooling tank 3 is rotatably supported by both bases 170. The header 172 is provided with a plurality of outside pipe cooling nozzles a 174 spaced in the longitudinal direction of the header and each extending toward the pipe 1 supported on the supporting portions 138 of the skids 135. The header 172 has a rotating arm 176 fastened thereto adjacent each base 170. A motor 178 and a reduction gear 179 are firmly mounted on the truck at the center of the upper end portion thereof. The reduction gear 179 has an output shaft 180 to which a driving arm 182 is fastened. The two ends of a connecting rod 185 which is U-shaped just like the truck 157 are pivotally connected respectively to the ends of the rotating arms 176 by pins 184. The connecting rod 185 is also rotatably connected at the center of the upper end thereof to the end of the driving arm 182 by a pin 186. On the outlet side of the skids 135, shock absorbers 188 each having a receiving rod 189 directed oppositely to the dropping direction of the pipe 1 are supported on support 190. The shock absorbers 188 prevent the pipe 1 rolling down on the sloping portions 137 of the skids 135 from hitting violently against the supporting portions 138. A liquid source 173 for supplying pressurized cooling liquid to the header 172 is connected to the header through a flexible tube 175.

The above described immersion cooling apparatus is operated in the following manner. As in the preceding embodiments, the pipe which is in a horizontal position is moved down to the supporting portions 138 of the skids 135 and locked thereon, and cooling liquid is injected from inside pipe cooling nozzle 62 into the pipe 1, while cooling liquid is jetted from the outside pipe cooling nozzles 174 onto the pipe 1.

The outside pipe cooling nozzles 174 are directed substantially toward the axis of the pipe 1. With changes in pipe size, however, it is necessary to change the jetting angle and vertical position of the nozzles 174 on each side. In order to change the jetting angle of the outside pipe cooling nozzles 74, the motor 178 is driven to rotate the driving arm 182, which in turn rotates the rotating arms 176 through the connecting rod 185. As a result, the header 172 rotates to vary the jetting angle of the nozzles 174 fastened thereto. Meanwhile, in order to change the vertical position of the outside pipe cooling nozzles 174, the motor 160 is driven to turn the driving arm 163, which in turn causes the connecting rod 165 linked thereto to move the truck 157 upward or downward on the guide rails 151.

It is also possible to change the vertical position of the pipe instead of varying the vertical position of the pipe outside cooling nozzles 174. In this case, the nozzles 174 are moved only to change the jetting angle. Meanwhile, the inside pipe cooling nozzle 62 has only the vertical position changed by, for example, vertically moving an elevating base to which the nozzle 62 is fastened.

Here follows a description of the supporting and locking of the pipe to be cooled. Normally employed in immersion cooling is an inside and outside pipe cooling method which minimizes bending of the pipe in an unrestrained condition. For example, inside pipe cooling is carried out with a proper inside flow velocity for each pipe size, while outside pipe cooling is practiced with an adequately positioned nozzle arrangement (jetting direction, pitch, number, etc.), jet velocity, and so forth. It has however been found as a result of an experiment that bending is promoted where the pipe has been bent before being immersed, or when the jet from the inside pipe cooling nozzle cannot pass completely through the pipe because of the occurrence of bending during the cooling. The experiment has also shown that it is necessary to lock the pipe in a condition in which the center of the pipe at the end thereof adjacent the nozzle is aligned with the axis of the nozzle.

Based upon the experiment, this invention seeks to minimize bending of the pipe being cooled due to the difference between the circumferential and longitudinal cooling conditions of the pipe, by providing a plurality of locking devices adequately spaced in the longitudinal direction of the pipe, each locking device comprising a supporting member and a pressing device, which clamps the pipe placed on the supporting member while the pipe is cooled. Such clamping is effective to prevent the pipe not only from bending but also from being forced to move by the jet of cooling liquid. Of course, in the case where the injection pressure of the inside pipe cooling nozzle and the flow velocity within the pipe are relatively high, pipe movement preventing means may be separately provided to prevent the pipe being cooled from moving downstream of the jet. Normally, however, the locking devices for clamping the pipe are also used to prevent the pipe from flowing. The pipe clamping force of the locking devices is adjustable for each pipe size (diameter and wall thickness) within a range wherein the pipe will not be crushed. This adjustment is accomplished by adjusting the pressure of application. Such a locking system has already been described in detail in conjunction with the embodiment shown in FIGS. 1 and 2.

Figure 11:
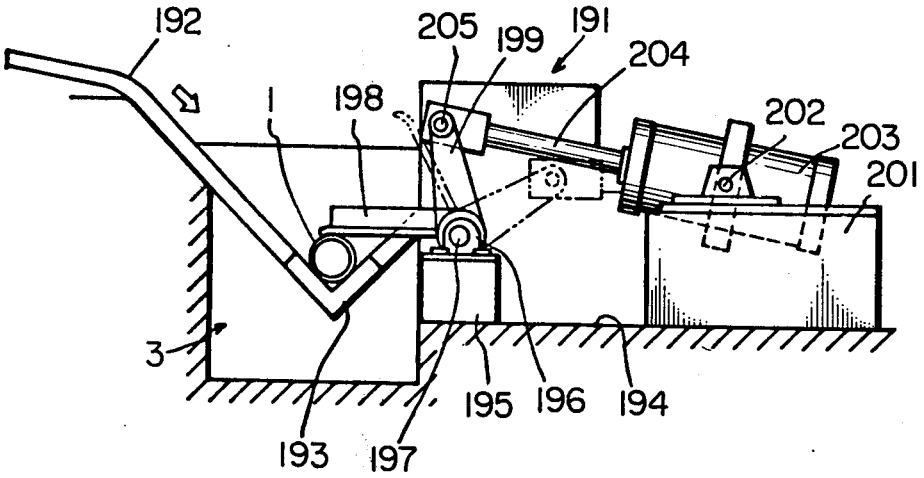
FIG. 11 is an end view of another pipe locking mechanism.

FIG. 11 illustrates another locking system comprising locking devices 191 as described hereinafter. As shown, a support 195 is provided on a floor 194 at a position opposite each skid 192, and a bearing 196 is securely support on the mount 195. The bearing 196 supports a rotating shaft 197, to which are secured a clamping arm 198 extending into the cooling tank 3 and a rotating arm 199 substantially perpendicular to the clamping arm 198. Also installed on the floor 194 is a support 201 to which a fluid pressure cylinder 203 is rotatably connected by a pin 202. The fluid pressure cylinder 203 has a rod 204, the end of which is pivotally connected to the rotating arm 199 by a pin 205. The locking devices 191 having such a construction are spaced in the longitudinal direction of the cooling tank 3.

The operation of the fluid pressure cylinders 203 causes the respective clamping arms 198 to rotate and press the pipe 1 placed on the supporting portions 193 of the skids 192 downwardly, thereby locking the pipe on the supporting portions 193. Thus, the pipe 1 is transversely locked at the top and lower areas thereof and longitudinally restrained by the plurality of locking devices 191 at intervals along the axis of the pipe. This condition is maintained until pipe cooling is completed. In this case also, the supporting portions 193 of the skids 192 may be replaced by separate supporting means independent of the skids, the separate supports being supported by adequate members.

As is apparent from the foregoing detailed description, the immersion cooling apparatus of the present invention produces uniform cooling of a pipe so that no bending or injury will occur to the pipe. Furthermore, since the tip of the inside pipe cooling nozzle is not inserted in the pipe, cooling can be started rapidly. In addition, the shock absorber arrangement is capable of preventing injury to the pipe due to the impact produced when the pipe is fed into the cooling tank. Also, the pipe locking system is effective to prevent the pipe from moving and allows stable pipe cooling.

What is claimed is:

1. An immersion cooling apparatus for hot metal pipes comprising:

a cooling tank for containing a body of cooling liquid in which the pipes are to be immersed for cooling;

a plurality of skids extending from outside of the cooling tank downwardly into the cooling tank to a level below the level of the surface of the cooling liquid and being spaced in the direction of the length of the cooling tank for guiding the pipe into the tank along the skids;

pipe supporting means in the tank at the lower end of said skids for supporting a pipe thereon;

a pipe leveling means having pipe holding members which cross said skids and means on which said holding members are mounted for moving said holding members for causing a pipe moving downwardly along the skids into the tank to remain in a horizontal position;

a cooling liquid nozzle in said tank aligned with the position of the axis of a pipe supported in said pipe supporting means and spaced from the adjacent end of a pipe supported in said pipe supporting means for injecting cooling liquid into the pipe, the space between the end of said cooling liquid nozzle and the position of the end of the pipe being such that cooling liquid around the end of a pipe will be sucked into the pipe and discharged from the other end of the pipe by the jet from the cooling liquid nozzle; and a source of cooling liquid under pressure connected to the cooling liquid nozzle for supplying cooling liquid to the cooling liquid nozzle.

2. An immersion cooling apparatus as claimed in claim 1 wherein said pipe holding members of said pipe leveling means are movable back and forth toward and away from said skids, whereby during operation of said apparatus the holding members are moved toward the skids near the upper ends thereof until the tip portions thereof cross the skids, the holding members are moved down along the skids and then the holding members are moved away from the skids adjacent the pipe supporting means.

3. An immersion cooling apparatus as claimed in claim 2 wherein the means for moving the holding members of said pipe leveling means includes driving means for causing the holding members to travel along the skids at a desired speed for lowering the hot metal pipe into the cooling tank along the skids at the desired speed.

4. An immersion cooling apparatus as claimed in claim 2 further comprising a framework spanning the cooling tank and in which said pipe holding members of said pipe leveling means are actuating levers rotatably mounted on said framework.

5. An immersion cooling apparatus as claimed in claim 1 further comprising a shock absorbing mechanism on said pipe supporting means, said shock absorbing mechanism comprising:

a horizontal shaft extending in the longitudinal direction of said cooling tank;

shock receiving levers rotatably mounted at the middle thereof on said shaft with one end of each lever being positioned in the vicinity of the pipe supporting position on said pipe supporting means;

an elastic member on the tip portion of said one end of each shock receiving lever and a receiving plate on said elastic member facing the pipe supporting position; and a damper means engaged with the other end of each shock receiving lever for exerting a damping force on each shock receiver lever.

6. An immersion cooling apparatus as claimed in claim 1 further comprising;

opposed pairs of guide rails sloping from outside the cooling tank thereinto;

a truck movable on said pair of guide rails;

a truck driving means connected to said trucks for receiprocating said trucks along said guide rails;

two headers extending horizontaly in the longitudinal direction of the cooling tank adjacent the position of a pipe in said pipe supporting means and rotatably mounted on the respective trucks for rotation around the longitudinal axis of the header;

outside pipe cooling nozzles on said headers spaced in the longitudinal direction of the headers and directed toward the position of a pipe in said pipe supporting means; and header driving means connected to said headers for rotating said headers around the respective longitudinal axes thereof.

7. An immersion cooling apparatus for hot metal pipes comprising:

a cooling tank for containing a body of cooling liquid in which the pipes are to be immersed for cooling;

a plurality of skids extending from outside of the cooling tank downwardly into the cooling tank to a level below the level of the surface of the cooling liquid and being spaced in the direction of the length of the cooling tank for guiding the pipe into the tank along the skids;

pipe supporting means in the tank at the lower end of said skids for supporting a pipe thereon;

a pipe leveling means having pipe holding members which cross said skids for supporting a pipe on the skids in a horizontal position at least at one position along said skids as the pipe moves downwardly along the skids into the tank so tht the pipe remains in a horizontal position as it moves along said skids subsequent to said one position;

a cooling liquid nozzle in said tank aligned with the position of the axis of a pipe supported in said pipe supporting means and spaced from the adjacent end of a pipe supported in said pipe supporting means for injecting cooling liquid into the pipe, the space between the end of said cooling liquid nozzle and the position of the end of the pipe being such that cooling liquid around the end of a pipe will be sucked into the pipe and discharged from the other end of the pipe by the jet from the cooling liquid nozzle; and a source of cooling liquid under pressure connected to the cooling liquid nozzle for supplying cooling liquid to the cooling liquid nozzle.

8. An immersion cooling apparatus as claimed in claim 7 in which said pipe leveling means is movable only toward and away from said skids to cross said skids only at said one position.

* * * * *